US009717277B2

(12) United States Patent
Mironov

(10) Patent No.: US 9,717,277 B2
(45) Date of Patent: Aug. 1, 2017

(54) INDUCTIVE HEATING DEVICE AND SYSTEM FOR AEROSOL-GENERATION

(71) Applicant: PHILIP MORRIS PRODUCTS S.A., Neuchatel (CH)

(72) Inventor: Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/900,321

(22) PCT Filed: May 21, 2015

(86) PCT No.: PCT/EP2015/061198

§ 371 (c)(1),
(2) Date: Dec. 21, 2015

(87) PCT Pub. No.: WO2015/177253

PCT Pub. Date: Nov. 26, 2015

(65) Prior Publication Data

US 2017/0079326 A1 Mar. 23, 2017

(30) Foreign Application Priority Data

May 21, 2014 (EP) ..... 14169188

(51) Int. Cl.
*H05B 6/10* (2006.01)
*A24F 47/00* (2006.01)
*H05B 6/36* (2006.01)

(52) U.S. Cl.
CPC ..... *A24F 47/008* (2013.01); *H05B 6/105* (2013.01); *H05B 6/108* (2013.01); *H05B 6/36* (2013.01)

(58) Field of Classification Search
CPC ..... A24F 47/004; A24F 47/008; A24B 3/14; H05B 6/108

(Continued)

(56) References Cited

U.S. PATENT DOCUMENTS 4,197,441 A * 4/1980 Rudd ..... B23K 13/02 219/106
5,613,505 A * 3/1997 Campbell ..... A24F 47/008 128/202.21

(Continued)

FOREIGN PATENT DOCUMENTS

CN 101390659 3/2009
CN 201445686 5/2010

(Continued)

OTHER PUBLICATIONS

PCT Search Report and Written Opinion for PCT/EP2015/061198 dated Sep. 14, 2015 (10 pages).

*Primary Examiner* — Thien S Tran
(74) *Attorney, Agent, or Firm* — Mueting, Raasch & Gebhardt, P.A.

(57) ABSTRACT

The inductive heating device (1) for aerosol-generation comprises a device housing comprising a cavity (13) having an internal surface for receiving at least a portion of an aerosol-forming insert (2) comprising an aerosol-forming substrate and a susceptor. The device housing further comprises an induction coil (15) having a magnetic axis, the induction coil (15) being arranged such as to surround at least a portion of the cavity (13). The device (1) yet further comprises a power source (11) connected to the induction coil (15) and configured to provide a high frequency current to the induction coil (15). Therein, a wire material forming the induction coil has a cross-section comprising a main portion, the main portion having a longitudinal extension in a direction of the magnetic axis and a lateral extension perpendicular to the magnetic axis, which longitudinal extension is longer than the lateral extension of the main portion.

20 Claims, 2 Drawing Sheets

(58) Field of Classification Search
USPC ..... 131/194, 273, 328, 329; 128/200.14, 128/200.23, 203.12, 203.26; 219/607, 219/621, 633, 660, 676
See application file for complete search history.

(56) References Cited

U.S. PATENT DOCUMENTS

| | | | | |
|---|---|---|---|---|
| 5,954,984 | A * | 9/1999 | Ablah | A47G 23/04 126/246 |
| 6,125,853 | A | 10/2000 | Susa | |
| 2006/0192644 | A1 | 8/2006 | Hendel | |
| 2012/0234315 | A1* | 9/2012 | Li | A24F 47/008 128/200.21 |
| 2013/0199027 | A1* | 8/2013 | Singh | H02J 50/12 29/602.1 |
| 2015/0245669 | A1* | 9/2015 | Cadieux | H05B 6/108 131/329 |

FOREIGN PATENT DOCUMENTS

| | | |
|---|---|---|
| CN | 103431524 | 12/2013 |
| CN | 103689812 | 4/2014 |
| EP | 2444112 | 4/2012 |
| JP | 08-51175 | 11/1996 |
| KR | 10-1999-0081973 | 11/1999 |
| KR | 10-2011-0047364 | 5/2011 |
| KR | 10-2013-0000137 | 1/2013 |
| WO | WO 95/27411 | 10/1995 |
| WO | WO 97/48295 | 12/1997 |
| WO | WO 98/23171 | 6/1998 |
| WO | WO 2014/048745 | 4/2014 |

* cited by examiner

INDUCTIVE HEATING DEVICE AND SYSTEM FOR AEROSOL-GENERATION

This application is a U.S. National Stage Application of International Application No. PCT/EP2015/061198, filed May 21, 2015,which was published in English on Nov. 26, 2015 as International Patent Publication WO 2015/177253. International Application No. PCT/EP2015/061198 claims priority to European Application No. 14169188.1 filed May 21, 2014.

The invention relates to inductively heatable smoking devices, wherein an aerosol may be generated by inductively heating an aerosol-forming substrate.

In electrically heatable devices, an ongoing restraint is the limited energy available by a battery provided in the device. The trend to a miniaturization of these devices put additional strain on these power supplies. For optimization of the use of energy inductive heating has been proposed. By inductive heating, better energy transfer into a to-be-heated part of the device and better energy conversion into heat may be achieved. However, miniaturized electric smoking devices still have to be recharged often, which may be inconvenient for a user.

Therefore, there is a need for improved inductive heating devices for aerosol-generation. Especially, there is a need for such devices with respect to energy efficiency.

According to an aspect of the invention, there is provided an inductive heating device for aerosol-generation. The device comprises a device housing comprising a cavity having an internal surface for receiving at least a portion of an aerosol-forming insert comprising an aerosol-forming substrate and a susceptor. The device housing further comprises an induction coil having a magnetic axis, wherein the induction coil is arranged such as to surround at least a portion of the cavity. The device further comprises a power source connected to the induction coil and configured to provide a high frequency current to the induction coil. A wire material forming the induction coil has a cross-section comprising a main portion. The main portion has a longitudinal extension in a direction of the magnetic axis and a lateral extension perpendicular to the magnetic axis. Preferably, the lateral extension perpendicular to the magnetic axis extends in a radial direction. The longitudinal extension of the main portion of the cross-section is longer than the lateral extension of the main portion of the cross-section. Simply spoken, the form of the wire material is flattened, entirely or at least in the main portion, compared to a conventional helical induction coil formed by a wire of circular cross-section. Thus, the wire material in the main portion extends along the magnetic axis of the coil and to a smaller extent into the radial direction. By this measure, energy loss in the induction coil may be lessened. Especially, capacitance loss may be lessened. Capacitance of two electrically charged objects is directly proportional to the surface area of two neighbouring surfaces—here the sides of neighbouring windings or turns that are facing each other in the induction coil. Thus, capacitance loss is lessened by reducing the extension of a winding in the perpendicular direction.

Preferably, the main portion has the form of a rectangle. In some preferred embodiments, the main portion forms the entire cross-section of the wire material. In these embodiments, the induction coil is helically formed by a wire material having a rectangular cross section, thus forms a helical flat coil (flat with respect to the form of the wire material). Such induction coils are easy to manufacture. Next to reduced energy loss, they have the additional advantage to minimize an outer diameter of the induction coil. This allows to minimize the device. The space gained by providing a flat coil may also be used for the provision of magnetic shielding without having to change the size of the device or even to additionally minimizing the device.

With the device according to the invention, the induction coil is arranged in the device housing, surrounding the cavity. This is favorable, since the induction coil may be arranged such as to not be in contact with the cavity or any material inserted into the cavity. The induction coil may completely be embedded in the housing, for example moulded into a housing material. The induction coil is protected from external influences and may be fixedly mounted in the housing. In addition, a cavity may be completely empty, when no insert is accommodated in the cavity. This may not only allow and facilitate the cleaning of the cavity but of the entire device without the risk of damaging parts of the device. Also no elements are present in the cavity that might get damaged upon insertion and removal of an insert into and from the cavity, or that might need to be cleaned.

According to another aspect of the device according to the invention, the cross-section comprises a secondary portion. The secondary portion has a longitudinal extension in the direction perpendicular to the magnetic axis and a lateral extension in the direction of the magnetic axis, which longitudinal extension is longer than a lateral extension of the secondary portion. The lateral extension of the secondary portion is always smaller than the longitudinal extension of the main portion and the longitudinal extension of the secondary portion is always larger than the lateral extension of the main portion. By this, a cross section of a wire material may be kept large by still reducing energy loss in the induction coil. Capacitance is also inverse proportional to the distance of neighbouring surfaces. Thus, a capacitance may be made smaller by increasing the distance between neighbouring surfaces. Preferably, an induction coil is manufactured from a wire material homogeneous in size such that the windings of the induction coil are substantially identical. If the wire material is provided with a secondary portion with enlarged extension in the radial direction, these secondary portions of the individual windings are distanced from each other. They are distanced from each other not only by the distance between neighbouring windings as in conventional induction coils but also by the length of the longitudinal extension of the main portion.

The provision of a secondary portion may also provide additional space between the induction coil and an outer wall of the device housing or also between individual windings. In this space gained by miniaturizing the coil dimensions, for example a shielding material may be arranged.

Preferably, the cross section of a wire material having a main portion and a secondary portion is L-shaped.

Preferably, the induction coil is arranged close to the cavity in order to be close to a susceptor inserted into the cavity to be heated by the electromagnetic field generated by the induction coil. Thus, if the cross-section of the wire material of the induction coil comprises a secondary portion, wherein a longitudinal extension of the secondary portion exceeds the lateral extension of the main portion of the cross-section, the secondary portion preferably extends into an outward radial direction of the induction coil. By this, it may be guaranteed that the main portion is the portion of the cross-section closest to the cavity.

Another form of cross section of a wire material may be a T-shape. Therein, the T is arranged in an inversed manner and the 'head' of the T forms the main portion and is arranged parallel to the longitudinal axis of the cavity.

Yet another form of cross section is a triangle, wherein a basis of the triangle is arranged parallel to the magnetic axis of the induction coil and parallel to the longitudinal axis of the cavity. The form of induction coils according to the invention may generally be defined by having a cross section having a maximum longitudinal extension forming one side of the cross-section. Therein, the wire material is arranged such that the maximum longitudinal extension of the cross section of the wire material extends parallel to the magnetic axis of the induction coil. Therein, the wire material also surrounds the cavity such that the maximum longitudinal extension of the cross section of the wire material is arranged most proximate to the cavity. Any further longitudinal extension of the cross section is equal to, for example in flat coils, or smaller, for example in triangularly shaped induction coils, than the maximum longitudinal extension.

According to another aspect of the device according to the invention, the wire material of the induction coil is made of Litz-wire or is a Litz cable. In Litz materials a wire or cable is made of individual, isolated wires, for example bundled in a twisted manner or braided. Litz materials are especially suitable to carry alternating currents. The individual wires are designed to reduce skin effect and proximity effect losses in conductors at higher frequencies and allow the interior of the wire material of the induction coil to contribute to the conductivity of the inductor coil.

A high frequency current provided by the power source flowing through the induction coil may have frequencies in a range between 1 MHz to 30 MHz, preferably in a range between 1 MHz to 10 MHz, even more preferably in a range between 5 MHz to 7 MHz. The term 'in a range between' is herein understood as explicitly also disclosing the respective boundary values.

According to a further aspect of the device according to the invention, the induction coil comprises three to five windings. In these embodiments, preferably the cross-section of the wire material, or the main portion thereof, respectively, forms a flat rectangle. By this, an induction coil of sufficient length may be manufactured in a very efficient manner. Manufacturing becomes especially effective if the induction coil is a flat coil and Litz cable is used for forming the induction coil.

These sizes for the main portion or for a flat coil have shown to be in an optimized range for the manufacture of an induction coil for the use in the device according to the invention. Especially, these sizes are optimized for an induction coil for use in an inductively heated smoking device.

According to yet another aspect of the device according to the invention, the device further comprises a magnetic shield provided between an outer wall of the device housing and the induction coil. A magnetic shield provided outside of the induction coil may minimize the electro-magnetic field reaching an exterior of the device. Preferably, a magnetic shield surrounds the induction coil. Such a shield may be achieved by the choice of the material of the device housing itself. A magnetic shield may for example also be provided in the form of a sheet material or an inner coating of the outer wall of the device housing. A shield may for example also be a double or multiple layer of shield material, for example mu-metal, to improve the shielding effect. Preferably, the material of a shield is of high magnetic permeability and may be of ferromagnetic material. A magnetic shield material may also be arranged between individual windings of the induction coil. Preferably, the shield material is then provided—if present—between secondary portions of the cross-section of the wire material. By this, space between the secondary portions may be used for magnetic shielding. Preferably, shield material provided between windings is of particulate nature.

A magnetic shield may also have the function of a magnetic concentrator, thus attracting and directing the magnetic field. Such a field concentrator may be provided in combination with, in addition to or separate from a magnetic shielding as described above.

According to an aspect of the device according to the invention, a circumferential portion of the inner surface of the cavity and the induction coil are of cylindrical shape. In such an arrangement, the magnetic field distribution is basically homogeneous inside the cavity. Thus, a regular or symmetric heating of the aerosol-forming insert accommodated in the cavity may be achieved, depending on the arrangement of the susceptor. In addition, cleaning of a cylindrical cavity is facilitated since no or only few edges are present where dirt or remainders may get stuck.

Preferably an aerosol-generating insert snugly fits into the cavity of the device housing such that it may be held by the internal surface of the cavity. The internal surface of the cavity or the device housing may also be formed to provide better hold for the inserted insert. According to another aspect of the device according to the invention, the device housing comprises retaining members for holding the aerosol-forming insert in the cavity when the aerosol-forming insert is accommodated in the cavity. Such retaining members may for example be protrusions at the internal surface of the cavity extending into the cavity. Preferably, protrusions are arranged in a distal region of the cavity, near or at an insertion opening where an aerosol-forming insert is inserted into the cavity of the device housing. For example, protrusion may have the form of circumferentially running ribs or partial ribs. Protrusions may also serve as aligning members for supporting an introduction of the insert into the cavity. Preferably, aligning members have the form of longitudinal ribs extending longitudinally along the circumferential portion of the inner surface of the cavity. Protrusions may also be arranged at the pin, for example extending in a radial direction. Preferably, retaining members provide for a certain grip of the insert such that the insert does not fall out of the cavity, even when the device is held upside down. However, the retaining members release the insert again preferably without damaging the insert, when a certain release force is exerted upon the insert.

According to another aspect of the invention, there is also provided an inductive heating and aerosol-generating system. The system comprises a device with an induction coil as described in this application and comprises an aerosol-forming insert comprising an aerosol-forming substrate and a susceptor. The aerosol-forming substrate is accommodated in the cavity of the device and arranged therein such that the susceptor of the aerosol-forming insert is inductively heatable by electromagnetic fields generated by the induction coil.

Aspects and advantages of the device have been described above and will not be repeated.

The aerosol-forming substrate is preferably a substrate capable of releasing volatile compounds that can form an aerosol. The volatile compounds are released by heating the aerosol substrate. The aerosol-forming substrate may be a solid or liquid or comprise both solid and liquid components.

The aerosol-forming substrate may comprise nicotine. The nicotine containing aerosol-forming substrate may be a nicotine salt matrix. The aerosol-forming substrate may comprise plant-based material. The aerosol-forming substrate may comprise tobacco, and preferably the tobacco containing material contains volatile tobacco flavour compounds, which are released from the aerosol-forming substrate upon heating. The aerosol-forming substrate may comprise homogenised tobacco material.

Homogenised tobacco material may be formed by agglomerating particulate tobacco. Where present, the homogenised tobacco material may have an aerosol-former content of equal to or greater than 5% on a dry weight basis, and preferably between greater than 5% and 30% by weight on a dry weight basis.

The aerosol-forming substrate may alternatively comprise a non-tobacco-containing material. The aerosol-forming substrate may comprise homogenised plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine.

The aerosol-forming substrate may comprise other additives and ingredients, such as flavourants.

The susceptor is a conductor that is capable of being inductively heated. A susceptor is capable of absorbing electromagnetic energy and converting it to heat. In the system according to the invention, the changing electromagnetic field generated by the one or several induction coils heats the susceptor, which then transfers the heat to the aerosol-forming substrate of the aerosol-forming insert, mainly by conduction of heat. For this, the susceptor is in thermal proximity to the material of the aerosol forming substrate. Form, kind, distribution and arrangement of the or of the several susceptors may be selected according to a user's need.

In some preferred embodiments, the aerosol-forming insert is a cartridge comprising a susceptor and containing a liquid, preferably comprising nicotine. In some other preferred embodiments, the aerosol-forming insert is a tobacco material containing unit comprising a susceptor. The tobacco material containing unit may be a unit comprising a susceptor and a tobacco plug made of a homogenized tobacco material. The tobacco material containing unit may further comprise a filter arranged at a mouth end of the tobacco material containing unit.

Since a cavity in the device housing of the device according to the invention may have a simple open form, for example the form of a tubular cup, also the manufacture of an insert to be inserted into the cavity may be facilitated. Such an insert may for example be of tubular shape.

The invention is further described with regard to embodiments, which are illustrated by means of the following drawings, wherein FIG. 1 is a schematic drawing of an inductive heating device comprising a flat induction coil with an aerosol-forming substrate inserted into a cavity of the device;

Figure 1:
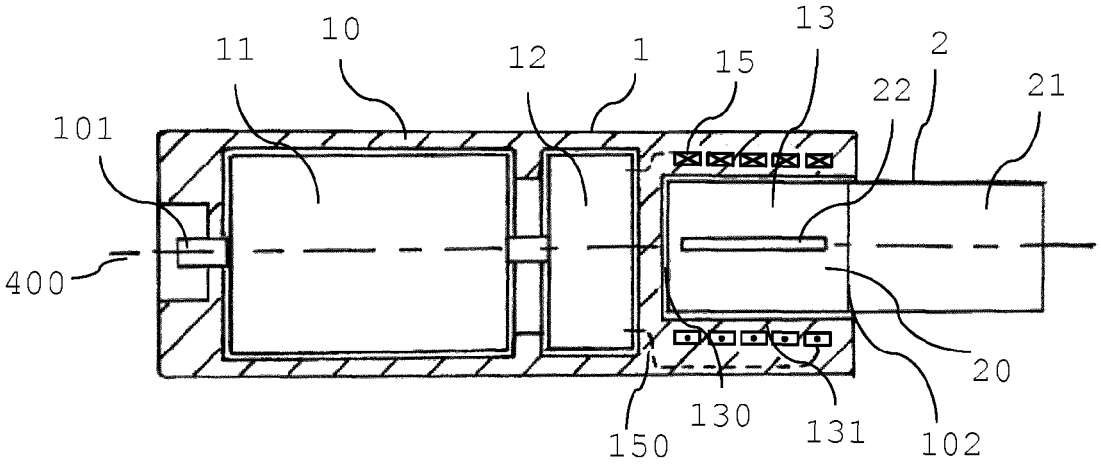

FIG. 1 schematically shows an inductive heating device 1 and an aerosol-forming insert 2 that in the mounted state of the aerosol-forming insert 2 form an inductive heating system. The inductive heating device 1 comprises a device housing 10 with a distal end having contacts 101, for example a docking port and pin, for connecting an internal electric power source 11 to an external power source (not shown), for example a charging device. The internal power source 11, for example a rechargeable battery 11, is provided inside the device housing in a distal region of the housing 10.

The proximal end of the device housing has an insertion opening 102 for inserting the aerosol-forming insert 2 into a cavity 13. The cavity 13 is formed inside the device housing in the proximal region of the device housing. The cavity 13 is configured to removably receive the aerosol-forming insert 2 inside the cavity 13. A helical induction coil 15 is arranged inside the device between outer wall 103 of the device housing 10 and cavity side walls 131. The magnetic axis of the induction coil 15 corresponds to a longitudinal axis 400 of the cavity 13, which again, in this embodiment, corresponds to the longitudinal axis of the device 1. Embodiments of the cavity, induction coil and proximal region of the device housing will further be described in more detail in FIG. 2 to 6 below.

The device 1 further comprises electronics 12, for example a printed circuit board with circuitry. The electronics 12 as well as the induction coil 15 receive power from the internal power source 11. The elements are interconnected accordingly. Electrical connections 150 to or from the induction coil 15 are led inside the housing but outside the cavity 13. The induction coil 15 has no contact to the cavity 13 or any element that may be arranged or present inside the cavity. Thus, any electric components may be kept separate from elements or processes in the cavity 13. This may be the aerosol-forming unit 2 itself but especially also residues emerging from the heating of the unit or of parts thereof and from an aerosol generating process. Preferably, a separation of the cavity 13 and the distal region of the device 1 with electronics 12 and power source 11 is fluid-tight. However, ventilation openings for allowing an airflow into the proximal direction of the device 1 may be provided in the cavity walls 130, 131 and in the device housing or both.

The cavity 13 has an internal surface formed by cavity walls 130, 131. One open end of the cavity 13 forms the insertion opening 102. Through the insertion opening, the aerosol-forming unit 2, for example a tobacco plug or an aerosol-containing cartridge may be inserted into the cavity 13. Such an aerosol-forming unit is arrangeable in the cavity such that a susceptor 22 of the unit when the unit is accommodated in the cavity 13 is inductively heatable by electromagnetic fields generated in the induction coil 15 and currents induced in the susceptor. The bottom wall 131 of the cavity 13 may form a mechanical stop when introducing unit 2.

The aerosol-forming insert may for example comprise an aerosol-forming substrate, for example a tobacco material and an aerosol former containing plug 20. The insert 2 comprises a susceptor 22 for inductively heating the aerosol-forming substrate and may comprise a cigarette filter 21. Electromagnetic fields generated by the induction coil inductively heat the susceptor in the aerosol-forming substrate 20. The heat of the susceptor is transferred to the aerosol-forming insert thus evaporating components that may form an aerosol for inhalation by a user.

Figure 2:
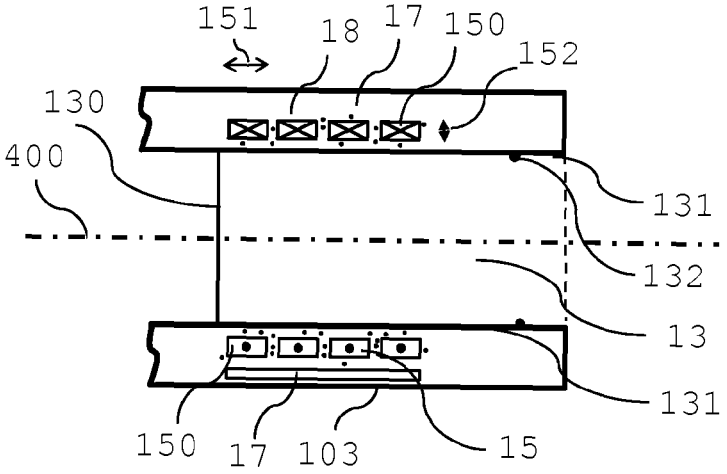
FIG. 2 shows a cross-section section of an excerpt of an inductive heating device for example as shown in FIG. 1 with a cavity surrounded by a flat induction coil and magnetic shielding.

FIG. 2 shows an enlarged cross-section of a cavity 13 of an inductive heating device, for example the inductive heating device of FIG. 1. The cavity is formed by cavity side walls 131 and bottom wall 130 and has an insertion opening 102. Between the cavity side walls 131 and an outer wall 103 of the device housing 10 the flat induction coil 15 is arranged. The flat induction coil 15 is a helical coil and extends along the length or part of the length of the cavity. Preferably, outer wall 103, device housing 10, flat induction coil 15 and cavity 13 are of tubular shape and are arranged concentrically. The flat induction coil may be embedded in the device housing. Preferably, the flat induction coil is made of a flat wire or a Litz cable. Preferably, the material of the induction coil is copper.

The cavity 13 may be provided with retentions for holding the aerosol-forming unit in the cavity. Retentions in the form of an annularly arranged protrusion 132 extend into the cavity. Cavity walls 131 and the device housing 10 may be made of the same material and are preferably made of plastics material. Preferably, cavity walls 130,131 are formed in one piece, for example by injection moulding.

The large extension 151 of the windings 150 of the induction coil in longitudinal direction allows for the generation of a rather homogenous electromagnetic field inside the coil and along the magnetic axis 400 of the coil. However, the narrow extension 152 of the windings of the induction coil in radial direction limits capacity losses. It also allows to either enlarge the diameter of the cavity 13 or to limit the diameter of the device 1.

A sheet of shield material 17 is concentrically arranged between induction coil 15 and housing wall 103. The sheet of material serves as magnetic shield. Preferably, the shield material is of high magnetic permeability, such that an inducing field may enter the shield material and be guided inside the sheet material. Preferably, mu-metal is used as sheet material.

The factor of reducing the field outside of the shield material 17 is dependent upon the permeability of the magnetic material of which the shield is made, the thickness of this material that provides a magnetic conducting path, and the frequency of the magnetic fluctuation. Thus, the sheet material and its arrangement may be adapted to a specific use and application. The sheet material may also work in the form of blocking the magnetic fields, for example by making use of the formation of eddy currents in the shield material. This way of shielding is especially suitable at higher frequencies. For such shields, electrically conducting material is used.

In addition to the sheet of shield material 17, also further shield material in the form of particulate material 18 may be provided between shield material 17 and housing wall 103. Preferably, the particulate material 18 is a field concentrator material and is arranged between the windings 150 of the induction coil 15.

Figure 3:
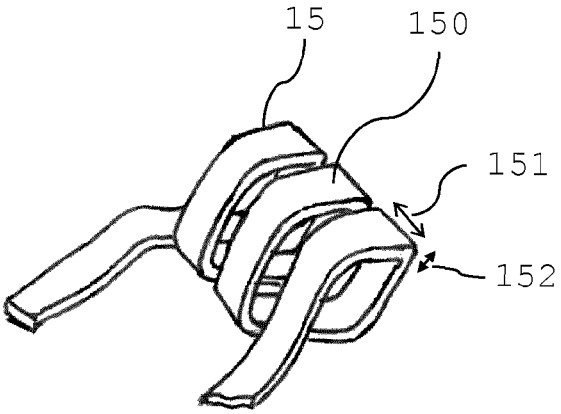
FIG. 3 shows an embodiment of a flat induction coil having a square diameter.

FIG. 3 shows a flat helical induction coil 15 made of Litz cable. The induction coil 15 has three windings 150 and a length of about 22 millimeters. The induction coil 15 itself has a square form.

Figure 4:
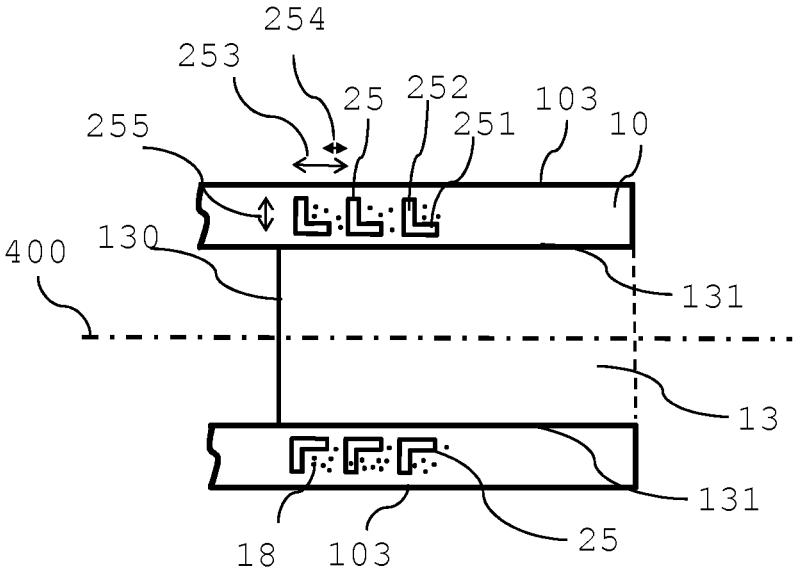
FIG. 4 shows a cross-section section of an excerpt of an inductive heating device with a cavity surrounded by an L-shaped induction coil.

FIG. 4 shows an enlarged cross section of a cavity 13 of an inductive heating device for example as described in FIG. 1. The same reference numerals as in FIG. 2 are used for the same or similar elements.

Between the cavity side walls 131 and the device housing 10 or outer wall 103 an L-shaped induction coil 25 is arranged. The induction coil 25 is a helical coil wherein the winding material, the L-shaped induction coil 25 is manufactured from, has an L-shaped cross-section.

The L-shaped induction coil 25 extends along the length or part of the length of the cavity 13. Preferably, a device housing 10, at least in the region of the cavity, the L-shaped induction coil 25 and the cavity 13 are of tubular shape and are arranged concentrically. The L-shaped induction coil is arranged inside the device housing 10 and may be embedded therein.

The 'foot' 251 of the 'L' (or main portion of the cross section) may have a size as for example the length of a flat induction coil as described in connection with FIGS. 2 and 3. Preferably, the 'leg' 252 of the 'L' (or secondary portion of the cross section) has a same or smaller extension 255 in radial direction than the 'foot' in longitudinal direction.

Again, a capacity loss between individual windings 250 is smaller than with a comparable circular shaped wire used for common induction coils. The distance 253 between legs 252 of the windings 150 (or the secondary portion with large extension in radial direction) is much larger than the distance 254 between neighbouring windings 150. The surface between windings 150 directly adjacent each other and facing each other are dominated by the rather flat 'foot' (or main portion of the cross section) of the L-shaped winding.

In the space formed by the L of the L-shaped induction coil 25 and in between the individual windings, concentrator material 18 is arranged.

Figure 5:
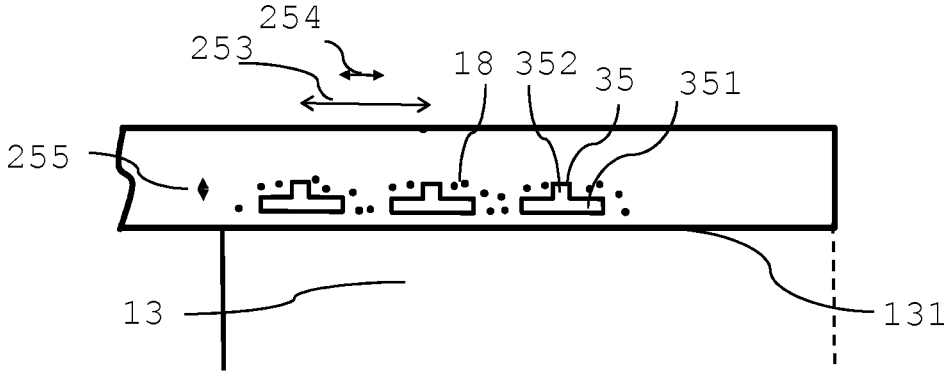
FIG. 5 shows an excerpt of a cavity surrounded by an inverse T-shaped induction coil.
Figure 6:
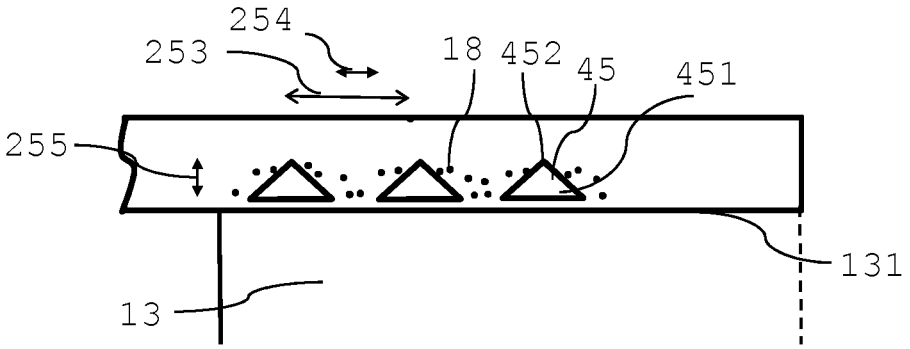
FIG. 6 shows an excerpt of a cavity surrounded by a triangularly shaped induction coil.

In FIGS. 5 and 6, two further embodiments of induction coil cross sections are shown. In FIG. 5 the cross section has an inverse T-shape. The 'head' 351 is the part of the induction coil the most proximate to the cavity 13. The 'head' of the T is arranged parallel to the side wall 131 of the cavity 13 or to the longitudinal central axis 400 of the cavity.

The 'leg' 352 of the T extends in radial direction with respect to the central axis 400 of the cavity 13. Again, the distance 253 between legs of the T is larger and preferably about double to three times the distance 254 between individual windings 351 of the induction coil 35. Concentrator material 18 is provided between the windings 351 of the induction coil 35. The concentrator material 18 may be kept in place by the 'legs' of the T-shaped cross section of the material of the induction coil 35.

As shown in FIG. 6, the cross-section of the induction coil 45 may be of triangular shape. The base 451 of the triangle is arranged parallel to the side wall 131 of the cavity 13. The base 451 is the largest extension of the triangle in longitudinal direction of the cavity 13 and is arranged most proximate to the cavity 13. The tip 452 of the triangle is the smallest extension of the triangle in longitudinal direction and arranged most remote from the cavity. Tips 452 direct away from the cavity. Again tip to tip 452 distance 253 is larger than a distance 254 between neighbouring windings 45.

The radial extension 255 of the triangle may be smaller or larger than the longitudinal extension (base 451) of the triangle but is preferably smaller in order to keep a diameter of the induction coil 45 small.

Induction coil arrangements as well as the inductive heating device are shown by way of example only. Variations, for example, length, number of windings, location or thickness of an induction coil may be applied depending on a user's need or on an aerosol-forming unit to be heated and used together with a device.

The invention claimed is:

1. Inductive heating device for aerosol-generation, the device comprising:

a device housing comprising a cavity having an internal surface for receiving at least a portion of an aerosol-forming insert comprising an aerosol-forming substrate and a susceptor, the device housing further comprising an induction coil having a magnetic axis, the induction coil being arranged such as to surround at least a portion of the cavity;

a power source connected to the induction coil and configured to provide a high frequency current to the induction coil, wherein a wire material forming the induction coil has a cross-section comprising a main portion, the main portion having a longitudinal extension in a direction of the magnetic axis and a lateral extension perpendicular to the magnetic axis, which longitudinal extension is longer than the lateral extension of the main portion.

2. Device according to claim 1, wherein the main portion has a form of a rectangle.

3. Device according to claim 1, wherein the main portion forms the cross-section of the wire material.

4. Device according to claim 1, wherein the cross-section of the wire material further comprises a secondary portion, the secondary portion having a longitudinal extension perpendicular to the magnetic axis and a lateral extension parallel to the magnetic axis, which longitudinal extension is longer than the lateral extension of the secondary portion.

5. Device according to claim 4, wherein the cross-section of the wire material is L-shaped.

6. Device according to claim 1, wherein the wire material of the induction coil is made of Litz-wire or is a Litz cable.

7. Device according to claim 1, wherein the induction coil comprises three to five windings.

8. Device according to claim 1, further comprising a magnetic shield provided between an outer wall of the device housing and the induction coil.

9. Device according to claim 8, wherein the magnetic shield surrounds the induction coil and comprises a sheet material or an inner coating of the outer wall of the device housing.

10. Device according to claim 8, wherein the magnetic shield is arranged between individual windings of the induction coil.

11. Device according to claim 1, wherein a circumferential portion of the inner surface of the cavity and the induction coil are of cylindrical shape.

12. Device according to any claim 1, wherein the device housing comprises retaining members for holding the aerosol-forming insert in the cavity when the aerosol-forming insert is accommodated in the cavity.

13. Inductive heating and aerosol-generating system comprising a device according to claim 1 and an aerosol-forming insert comprising an aerosol-forming substrate and a susceptor, wherein the aerosol-forming substrate is accommodated in the cavity of the device and arranged therein such that the susceptor of the aerosol-forming insert is inductively heatable by electromagnetic fields generated by the induction coil.

14. System according to claim 13, wherein the aerosol-forming insert is one of a cartridge comprising a susceptor and containing a liquid and a tobacco material containing unit comprising a susceptor.

15. Device according to claim 2, wherein the main portion forms the cross-section of the wire material.

16. Device according to claim 2, wherein the cross-section of the wire material further comprises a secondary portion, the secondary portion having a longitudinal extension perpendicular to the magnetic axis and a lateral extension parallel to the magnetic axis, which longitudinal extension is longer than the lateral extension of the secondary portion.

17. Device according to claim 9, wherein the magnetic shield is arranged between individual windings of the induction coil.

18. System according to claim 14, wherein the liquid comprises nicotine.

19. Device according to claim 2, wherein the wire material of the induction coil is made of Litz-wire or is a Litz cable.

20. Device according to claim 2, wherein the induction coil comprises three to five windings.

* * * * *